US005834674A

United States Patent [19]

Rodriguez et al.

[11] Patent Number: 5,834,674

[45] Date of Patent: Nov. 10, 1998

[54] DEVICE FOR EJECTING A WEAPON FROM A SUBMEGIBLE LAUNCH TUBE AND METHOD

[75] Inventors: Gerard Rodriguez, Paris; Damien Roger, Soyaux, both of France

[73] Assignee: Etat Francais as represented by the Delegue General pour l'Armement, Paris, France

[21] Appl. No.: 522,660

[22] Filed: Sep. 1, 1995

[30] Foreign Application Priority Data

Sep. 8, 1994 [FR] France ..... 94 10756

[51] Int. Cl.[6] ..... B63G 8/32

[52] U.S. Cl. ..... 89/1.81; 89/1.809; 114/20.1; 114/238; 114/316

[58] Field of Search ..... 89/1.809, 1.81; 114/20.1, 21.1–21.3, 238, 316; 124/65

[56] References Cited

U.S. PATENT DOCUMENTS

| | | | |
|---|---|---|---|
| 2,848,970 | 8/1958 | Gunning | 114/238 X |
| 4,733,799 | 3/1988 | Wiskur | 124/65 X |
| 4,854,260 | 8/1989 | Woidich et al. | 114/316 |
| 5,099,745 | 3/1992 | Hubbell et al. | 89/1.8 |
| 5,231,241 | 7/1993 | Bissonnette | 89/1.81 |
| 5,363,791 | 11/1994 | Stallard, III | 114/318 |
| 5,447,115 | 9/1995 | Moody | 114/312 |
| 5,562,065 | 10/1996 | Duarte et al. | 114/238 |

FOREIGN PATENT DOCUMENTS

| | | |
|---|---|---|
| 2 701 102 | 8/1994 | France . |
| 33 33 614 A1 | 4/1985 | Germany . |

*Primary Examiner*—Michael J. Carone
*Assistant Examiner*—Matthew J. Lattig
*Attorney, Agent, or Firm*—Oliff & Berridge, PLC

[57] ABSTRACT

A device for ejecting a weapon from a submergible launch tube includes a front door and a rear door. The device has an inner tube inside the launch tube and shaped to receive a weapon. The device also has holder elements for holding the inner tube in the launch tube and a pump device for circulating fluid between a front and a rear of the launch tube and the inner tube at a high flowrate.

25 Claims, 4 Drawing Sheets

DEVICE FOR EJECTING A WEAPON FROM A SUBMEGIBLE LAUNCH TUBE AND METHOD

BACKGROUND OF THE INVENTION

The invention relates to a device for ejecting or launching a weapon from a submerged launch tube, particularly on board a submarine.

A launch tube is classically provided with a front door located in the forward section of the hull beyond the resistant front bulkhead of the submarine, that is opened to launch or "expel" a weapon, and a rear door known as a breech.

Submarine-borne weapon launching devices employing turbopumps are already known.

Such devices comprise, in addition to the launch tube and an associated launch tube filling and emptying system, a turbopump device driven by a compressed-air turbine that discharges the water entering a water inlet circuit into a launching tank terminating in the launch tube via an annular water inlet door. The compressed air drives the turbine coupled to a pump outside the resistant hull, that moves the water inside a cylinder to bring it into the launch tank, thus creating an overpressure relative to the submersion pressure. The pressure differential is then used, after the annular water inlet door has been opened, to create behind the weapon the desired piston effect required for its ejection.

The operation of such a turbopump associated with a launch tube requires an upstream water inlet integrated into the forward section of the hull of the submarine, that makes the architecture of the forward section of the hull more complex and may be the source of difficulties.

Classically, a turbopump is associated with a group of two or three launch tubes, reducing the defense capabilities in the event the turbopump fails.

The water inlet circuit and the launch tank of a turbopump are space-consuming, especially if the submarine has several groups of launch tubes as, in this case, several turbopumps and their associated operating circuits are necessary.

Moreover, the wire-guided operation of a torpedo is complicated by the presence of the operating circuit of the turbopump. In the case where two weapons wire-guided by two different launch tubes associated with one and the same turbopump are launched simultaneously, exact coordination of the operations is required as the water inlet door of the launch tube launching the first weapon must be closed before the second one is launched, independently of the closing of the front door of the launch tube, requiring separate mechanisms for opening, closing, and locking the front doors and the water inlet doors.

Moreover, integration of the turbopumps on a submarine by autoclave assembly is complex and implies substantial modification of the device, as well as constraints in the architecture of the forward hull.

Other devices for launching weapons from submarines using water pistons are known, such as those described in U.S. Pat. No. 5,099,745, but they have the same drawbacks as the devices employing turbopumps.

Devices for launching weapons from launch tubes such as pneumatic rams are known, but they take up more space than turbopumps in the lengthwise direction since they require a supplementary launch tube length of about 400 to 500 millimeters. Despite their relatively limited performance because of submersion, for the last thirty years they have allowed weapons to be launched throughout the submersion range of submarines. The disadvantage of this type of device is that they bring about constraints in interfacing with the weapon.

SUMMARY OF THE INVENTION

The goal of the invention is to propose a device for ejecting a weapon from a submerged launch tube, particularly on board a submarine, that does not have the drawbacks of the known devices described hereinabove.

The object of the invention is a device for ejecting a weapon from a launch tube. The launch tube is able to withstand the submersion pressure, fitted with a front door, that is opened when ejecting the weapon, a rear door, tube that is open having a inner tube inside the launch tube that is open at both its ends containing a weapon, and the launch tube having an inside diameter substantially the same as that of the cylindrical part of the weapon, means for holding the inner tube in the launch tube, and means for circulating water at a high flowrate from the front to the rear of the launch tube in the annular space between the launch tube and the inner tube.

In a first embodiment, the device for producing high-flowrate water circulation from the front to the rear of the launch tube in the annular space between the launch tube is the inner tube are comprised of a pump or screw pump associated with a generator.

In another embodiment of the invention, the device for producing high-flowrate water circulation from the front to the rear of the launch tube in the annular space between the launch tube is the inner tube are comprised of an annular pump.

Preferably, the generator associated with the pump or screw pump or annular pump is a turbine.

Preferably, the generator is built into the rear door of the launch tube.

The rear door of the launch tube can support the drive shaft of the means for producing high-flowrate water circulation in the annular space between the launch tube and the inner tube.

In these first two embodiments of the invention, the device for holding the inner tube in the launch tube is comprised of transverse structures having passageways for the water. These structures are so-called "sector" structures. They may be associated with lengthwise structures.

In another embodiment of the invention, the device for creating high-flowrate water circulation from the front to the rear of the launch tube in the annular space between the launch tube and the inner tube is comprised of a long annular hydraulic piston interfacing with the launch tube at two shoulders, that deploys under the action of a low-pressure compressed-air circuit known as a launching circuit.

The launch tube has a stop on its internal face with a front shoulder marking the deployed position of the piston and a rear shoulder marking the resting position of the piston.

The inner tube has lengthwise openings for passage of the water at the front and up to the rear shoulder of the stop.

In this embodiment, the device for holding the inner tube in the launch tube is comprised of transverse "sector" structures leaving passageways for the water at the front end of the inner tube and a transverse structure forming a watertight bulkhead at the rear end of the inner tube, the inner tube having water passageways at the rear.

In a different embodiment, the device for holding the inner tube in the launch tube is comprised of "sector" transverse structures leaving passageways for the water at each end of the inner tube.

In another embodiment, the device for creating high-flowrate water circulation in the annular space between the launch tube and the inner tube is comprised of a short annular hydraulic piston that deploys under the action of a compressed-air circuit at a higher pressure than submersion pressure, known as a launching circuit.

In this embodiment, the device for holding the inner tube in the tube is comprised of a transverse structure located at the front end of the inner tube forming a watertight bulkhead that withstands the pressure difference between the submersion pressure and the launching pressure, and by transverse "sector" structures leaving passageways for the water and located at the rear end of the inner tube.

In a different embodiment, the device for holding the inner tube in the launch tube is comprised of a transverse structure forming a watertight bulkhead at each end of the inner tube, whereby the inner tube has water passageways at the rear.

The annular hydraulic piston embodiments have a hydraulic brake.

They also have a "sector" damper to stop the piston and reduce its noise.

They also have a compressed-air return circuit for returning the annular piston to its initial resting position.

BRIEF DESCRIPTION OF THE DRAWINGS

Other characteristics and advantages of the present invention will appear on reading the description below of a few preferred embodiments provided for illustration and not limitation, and the attached figures of which.

DETAILED DESCRIPTION OF PREFERRED EMBODIMENTS

Figure 1:
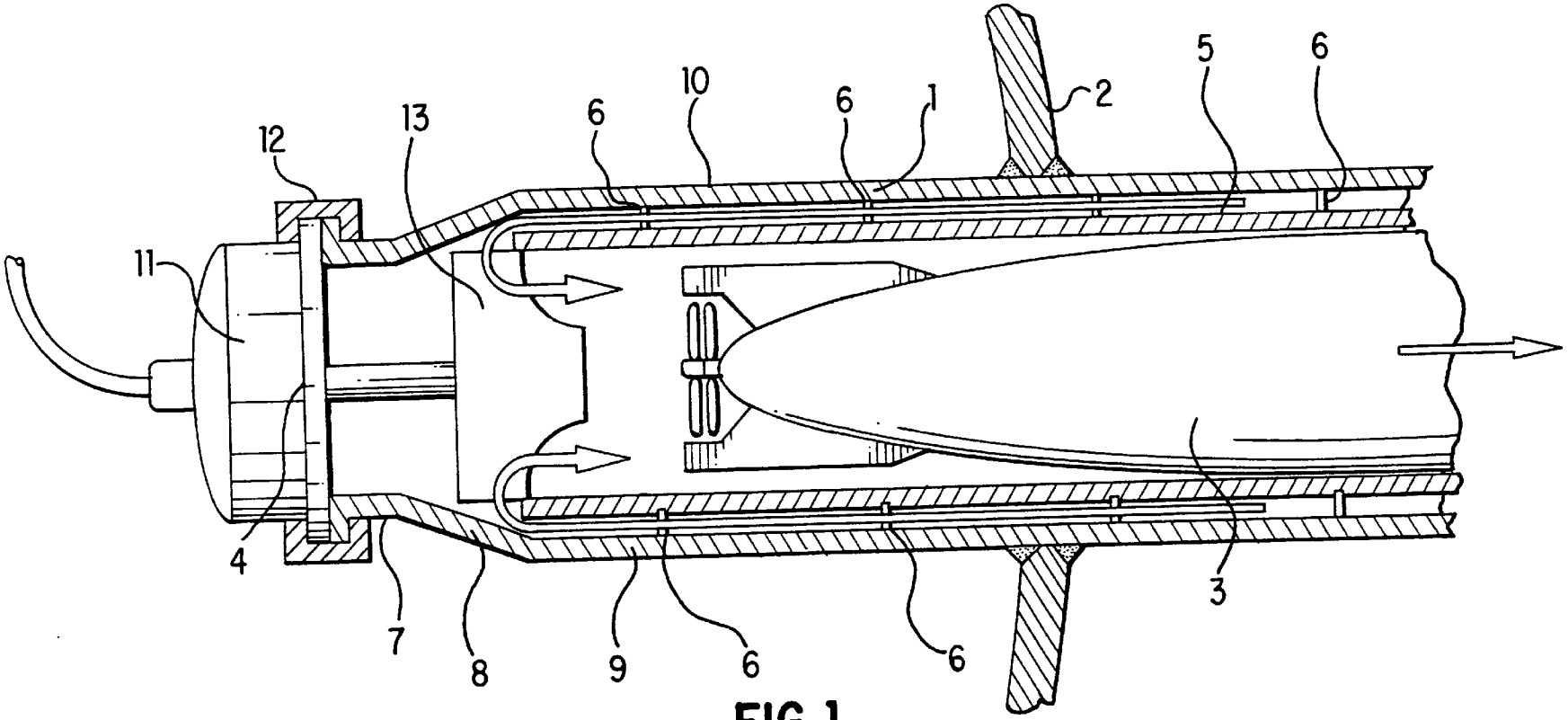
FIG. 1 represents a first embodiment of a device according to the invention, using a pump or a screw pump.

FIG. 1 represents a launch tube 1 built into a submarine, of which part of the resistant hull 2 can be seen. Launch tube 1 is classically provided with a front door not shown located beyond the resistant hull, designed to open for launching a weapon 3, for example a wire-guided torpedo, and a rear door 4.

Launch tube 1 is comprised of a tube 10 withstanding submersion pressure and having three zones 7, 8, and 9. Zones 7 and 9 are cylindrical, zone 9 having a greater diameter than zone 7, and are connected by a zone of revolution 8. The launch tube has an inner tube 5 in zone 9 that may be coaxial, open at both ends, designed to be in contact with weapon 3, with an inside diameter practically equal to that of the weapon.

Inner tube 5 ensures storage, locking, and guidance of the weapon when it is launched.

Transverse structures 6 that can be associated with lengthwise stiffeners are disposed between tubes 10 and 5 to ensure that inner tube 5 is held in tube 10.

Water circulation at a high flowrate, on the order of 2 $m^3$/sec, from the front to the rear of the launch tube in the annular space formed between tubes 5 and 10 is created by means 13 comprised of a pump, whose drive shaft is supported by rear door 4 of the launch tube.

Within the framework of the invention, the pump has dimensions such as to leave a location at the rear of the launch tube for the wire-guidance package and takes up little space because it is built into the launch tube, contrary to the weapon-launching devices of the prior art which employ turbopumps outside the launch tube.

The positioning of the pump provides a relative seal between the annular space between tubes 5 and 10 and the internal volume of tube 5.

The transverse structures serving to hold tube 5 in tube 10 are such that they do not disturb the passage of this water circulation. The transverse structures are disposed discontinuously to allow passageways for the water to appear, and are of the "sector" type.

The water ring delimited by the inner wall of tube 10 and the outer wall of tube 5 is dimensioned to allow a sufficient incoming water flowrate.

The profile of zone 8 at the pump is such as to allow water circulation with little pressure loss.

In the device shown in FIG. 1, the pump is coupled to a generator 11 built into the rear door 4 of the launch tube and that can be comprised of a turbine supplied with high-pressure air. In another embodiment, the generator may not be built into the launch tube and may be for example a hydraulic, magnetohydraulic, electrical, or inertial flywheel motor.

Rear door 4 allows the launch tube to be opened and closed for loading the weapon into the launch tube.

Rear door 4 is joined to the launch tube by a technologically secure link 12 such as an autoclave mechanism which avoids any risk of loss of tightness on submersion.

The operation of the weapon ejection device is simple.

Once the launch tube has been loaded in the traditional manner and filled with water by means of a filling and emptying system and balanced by a balancing circuit, the front door is opened and the weapon-locking device is retracted. Rotation of the pump allows circulation of water from the front to the rear of the resistant tube by means of the water ring and hence pressurization of the water volume behind tube 5. The result is a piston effect on the weapon which, in its cylindrical part, has essentially the same diameter as the inside diameter of the inner tube. When the weapon is expelled, the pump stops and it is possible, after emptying, to reload the launch tube with a weapon stored in the storage compartment.

In one embodiment, means 13 can be constituted by a screw pump.

Figure 2:
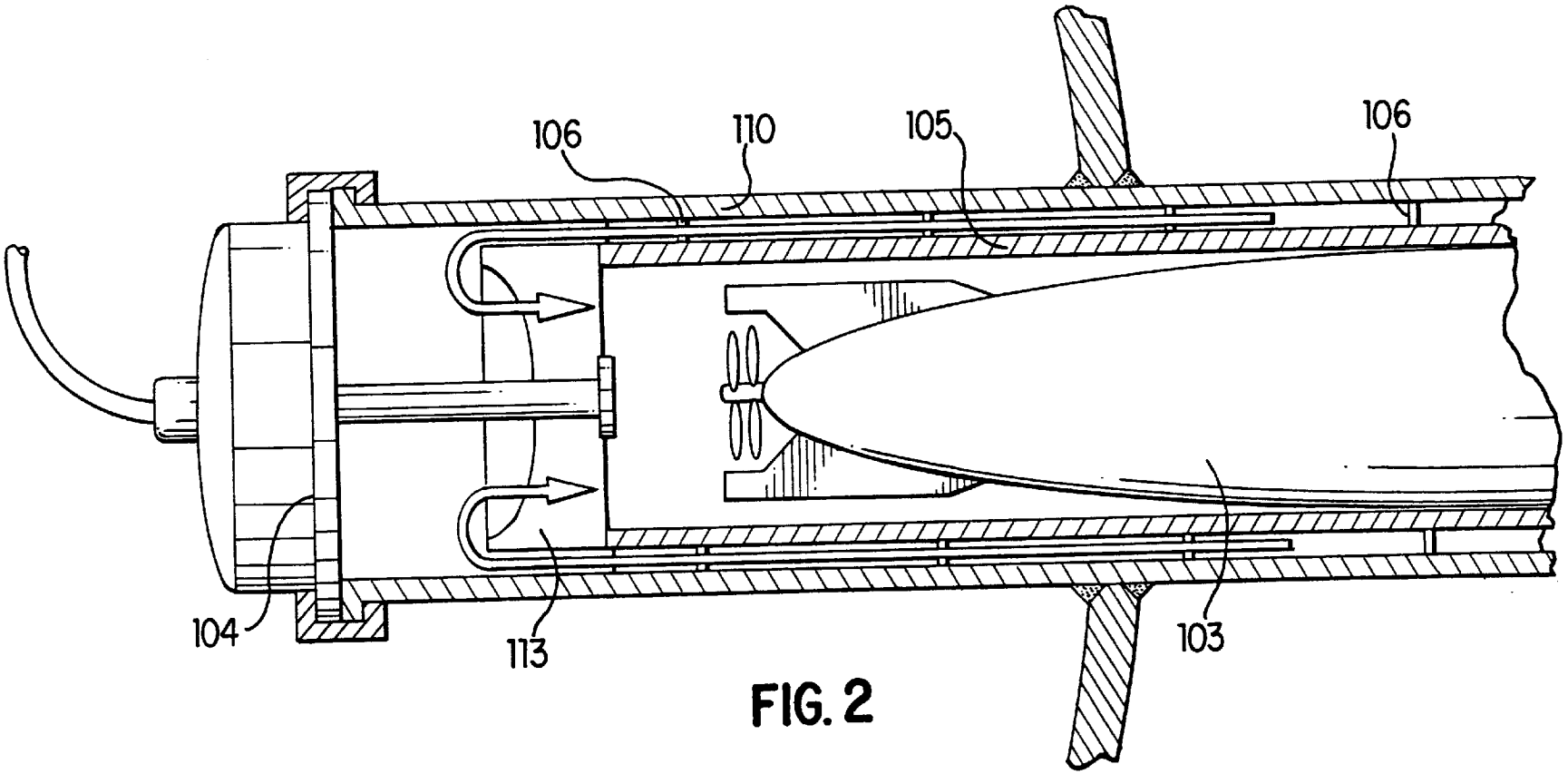
FIG. 2 represents a second embodiment of a device according to the invention, using an annular pump.

FIG. 2 represents a second embodiment of the invention wherein the launch tube is provided with a front door and a rear door 104 is comprised of a tube 110 that withstands submersion pressure and has an inner tube 105 open at both ends, designed to be in contact with a weapon 103 and having practically the same inside diameter as that of the weapon.

Transverse structures 106 may be associated with lengthwise stiffeners, disposed between tubes 110 and 105, ensuring that tube 105 is held in tube 110.

The high-flowrate circulation of water from the front to the rear of the launch tube in the annular space between tube 110 and inner tube 105 is created in this embodiment by an annular pump 113, that can be coupled to a generator that may or may not be built into rear door 104. The generator is preferably comprised of a turbine supplied with high-pressure air. The drive shaft of annular pump 113 is supported by rear door 104.

Figure 3:
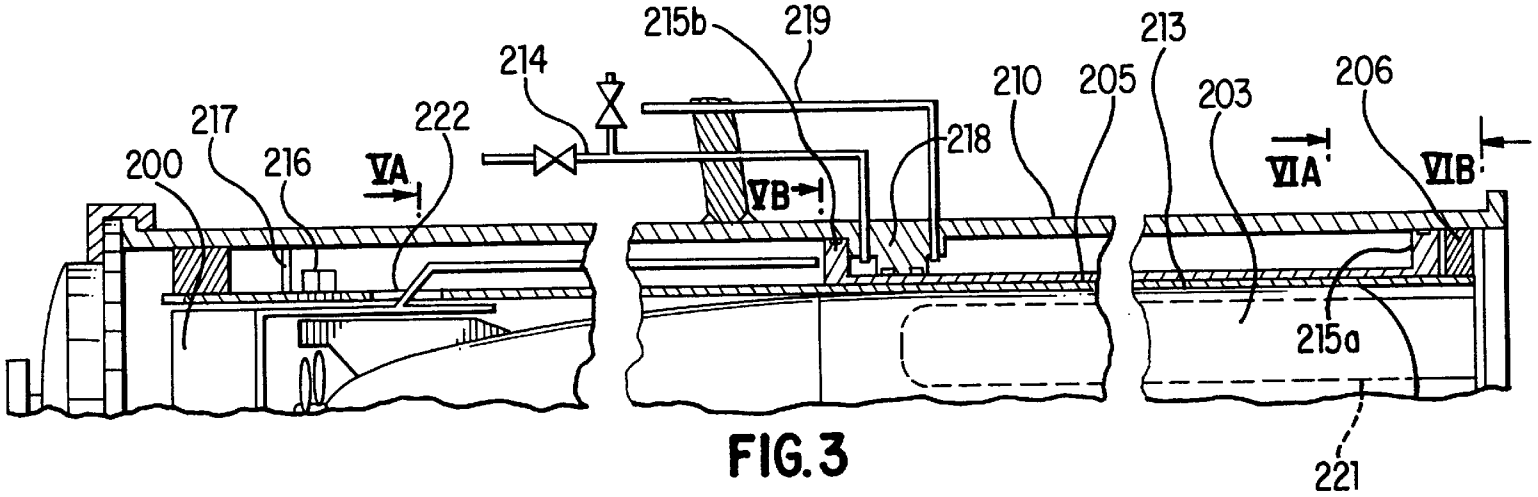
FIG. 3 represents a third embodiment of a device according to the invention, using a long annular hydraulic piston.
Figure 6:
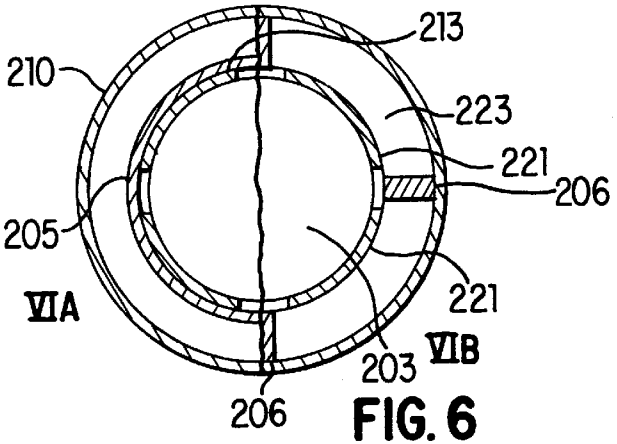
FIGS. 5 and 6 show sectional views of a device according to the invention.
Figure 5:
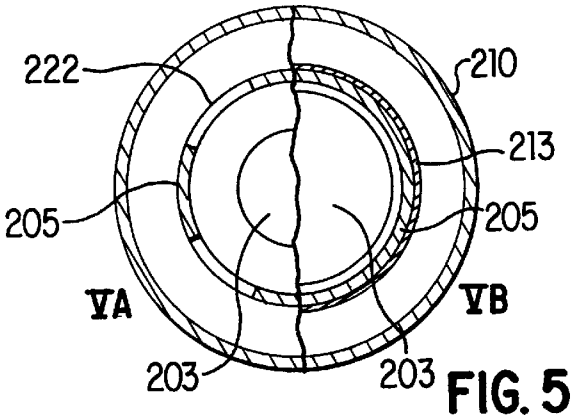

FIG. 3, 5 and 6 represent a third embodiment of the invention wherein the launch tube is comprised of a tube 210 that withstands the submersion pressure and has an inner tube 205 open at both ends, designed to be in contact with a weapon 203, with an inside diameter practically equal to that of the weapon. A location 200 for the wire-guidance package is provided at the rear of the weapon.

The high-flowrate circulation of water from the front to the rear of the launch tube in the annular space between tube 210 and inner tube 205 is created by a long annular hydraulic piston 213 operated by a low-pressure compressed-air circuit 214 known as a launching circuit.

The inner tube is attached to the forward end by transverse "sector" structures 206. A half-profile of the launch tube in a plane perpendicular to the axis of the launch tube and marked "VIB" shows these transverse "sector" structures at the front of the inner tube, having passageways 223 for the water inside the water ring. The inner tube is attached to the rear end by a transverse structure forming a watertight bulkhead.

The piston interfaces with the launch tube at two watertight shoulders, 215*a* in front of the piston and 215*b* behind the piston.

When the piston is in the resting position, the inside face of rear shoulder 215*b* of said piston interfaces with a rear shoulder of a stop 218.

At its front and up to the rear shoulder of stop 218, the inner tube has lengthwise openings 221 for passage of the water. The openings are clearly visible in the semi-profiles of the launch tube in planes perpendicular to the axis of the launch tube at points VIA and VIB. They allow accelerated water intake to fill the volume left empty by expelling the weapon.

A semi-profile of the launch tube in a plane perpendicular to the axis of the launch tube at point VB shows piston 213 in contact with inner tube 205.

The circulating water passes through passageways 222 provided at the rear of the inner tube and visible in a semi-profile of the launch tube in a plane perpendicular to the axis of the launch tube and point VA.

In one embodiment that does not have passageways 222, the circulating water passes through passageways in the transverse "sector" holding structures at the rear of the inner tube in the launch tube.

The volume of water displaced by the piston is greater than the volume of the weapon to be ejected.

At the end of its travel, piston 213 is pre-braked by a hydraulic brake 216 comprised of the reduced-diameter water passageways, and abuts a "sector" damper 217 with the outer face of rear shoulder 215*b* of the piston while the inner face of front shoulder 215*a* of the piston interfaces with a front shoulder of stop 218. Damper 217 stops the piston while damping the sound produced by the piston.

Once the weapon has been launched, the front door of the launch tube is closed, and the water from the launch tube evacuated by the filling and emptying system and a compressed-air return circuit 219 independent of the launching circuit or provided as a tap from the latter allows the piston to return to its initial resting position.

Figure 4:
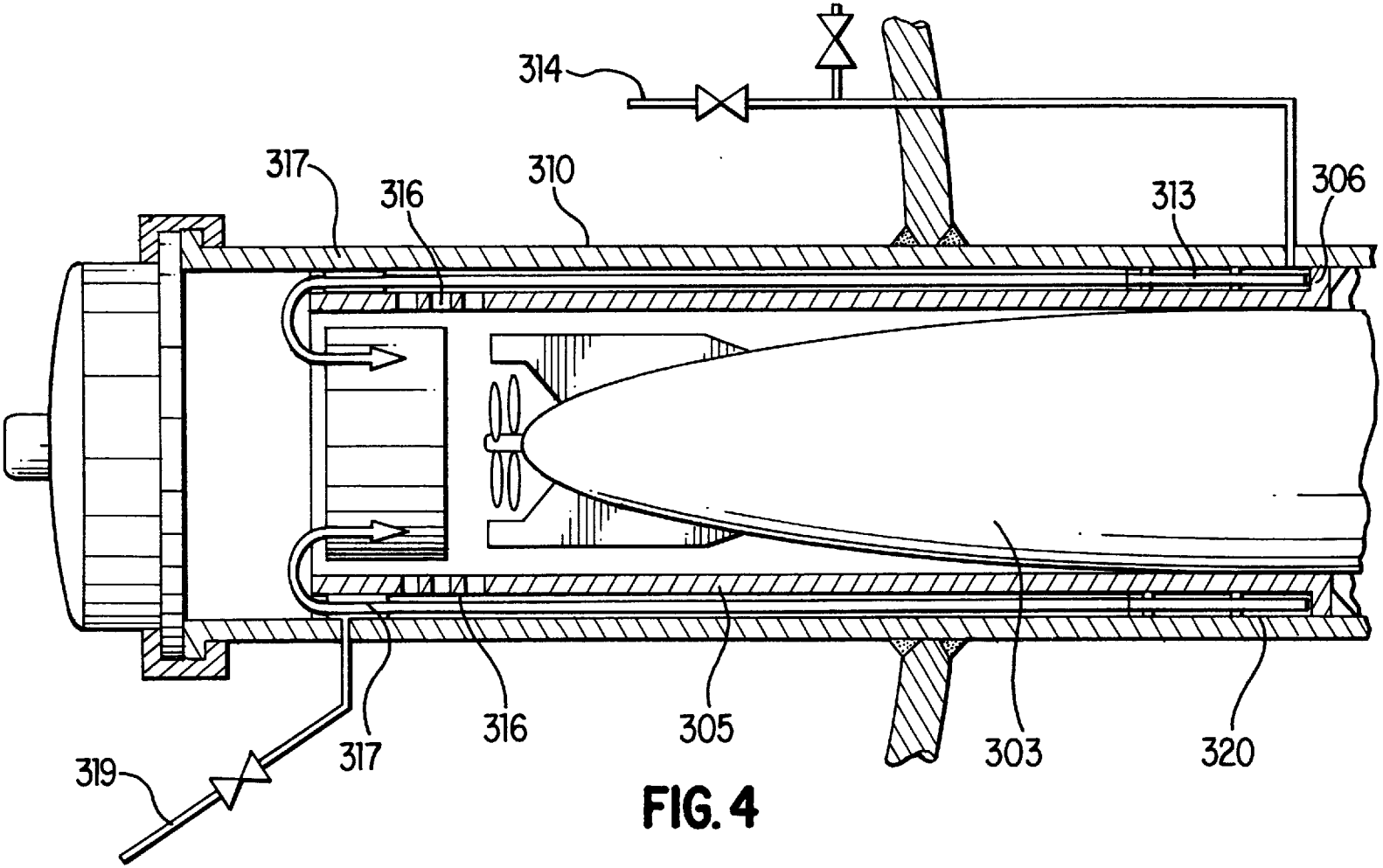
FIG. 4 represents a fourth embodiment of a device according to the invention, using a short annular hydraulic piston.

In another embodiment shown in FIG. 4, in which the launch tube is comprised of a tube 310 resistant to the submersion pressure and having an inner tube 305 open at both ends, designed to be in contact with a weapon 303, having an inside diameter practically equal to that of the weapon, a short annular hydraulic piston 313 is used to create the high-flowrate water circulation from the front to the rear of the launch tube in the annular space between resistant tube 310 and inner tube 305.

The inner tube is attached by transverse structures at each end of the inner tube. Front transverse structure 306 forms a watertight bulkhead resistant to the pressure differential between the submersion pressure and the launching pressure.

The short annular hydraulic piston is operated by a compressed-air circuit 314 known as the launching circuit, at a pressure greater than the submersion pressure.

The water in circulation passes through passageways at the transverse "sector" holding structures at the rear of the inner tube.

In one embodiment a transverse holding structure at the rear of the inner tube forms a watertight bulkhead and the circulating water passes through passageways provided at the rear of the inner tube.

The volume of water displaced by the piston is greater than the volume of the weapon to be ejected.

At the end of its travel, piston 313, pre-braked by a hydraulic brake 316, abuts a "sector" damper 317.

In the same manner as before, after the weapon has been launched, the front door of the launch tube is closed, and the water from the launch tube evacuated by the filling and emptying system and a compressed-air return circuit 319 allows the piston to return to its initial resting position marked by a stop 320.

Using the short hydraulic piston however has the drawback of being sensitive to submersion pressure.

The device according to the invention allows ejection of the weapon whatever the position of the launch tube: in the axis of the submarine, vertically, or horizontally with respect to the lengthwise axis of the submarine (known as the barbette position).

The device according to the invention also allows simultaneous launching of several wire-guided weapons.

What is claimed is:

1. A device for ejecting a weapon from a submergible launch tube having a front door and a rear door, comprising:

an inner tube configured to fit within the launch tube and shaped to receive the weapon;

holder elements configured to hold the inner tube within the launch tube; and a pump located inside the launch tube at a rear end of the inner tube to propel a fluid from an annular space between the inner tube and the launch tube.

2. The device according to claim 1, wherein the holder elements comprise a plurality of transverse sector structures attached to the inner tube and configured to extend between the launch tube and the inner tube and be attached to the launch tube, the plurality of transverse sector structures having an opening for the passage of fluid and being located at a front of the inner tube and a rear of the inner tube.

3. The device according to claim 1, wherein the pump is coupled to a generator.

4. The device according to claim 3, wherein the generator is a turbine.

5. The device according to claim 3, wherein the generator is built into the rear door of the launch tube.

6. The device according to claim 3, wherein a drive shaft of the generator is supported by the rear door of the launch tube.

7. The device according to claim 1, wherein the pump is activatable by a signal from a launch circuit.

8. The device according to claim 1, wherein the holder elements comprise a plurality of transverse sector structures attached to the inner tube and configured to extend between the launch tube and the inner tube and to be attached to the launch tube, the plurality of transverse sector structures having a plurality of passageways for circulation of fluid within an annular space between the launch tube and the inner tube.

9. The device according to claim 8, wherein the pump is configured to form a seal in the annular space.

10. A device according to claim 1, wherein fluid is propelled at a flow rate of about 2 $m^3$/sec.

11. Apparatus for launching a weapon, comprising:

a submergible launch tube having a front door and a rear door;

an inner tube held within and spaced from an inner surface of the launch tube and shaped to receive the weapon;

a pump positioned to propel fluid along and outside of the inner tube in an annular space between the inner tube and said inner surface of the launch tube; and a plurality of transverse sector structures attached to and extending between the launch tube and the inner tube, the plurality of transverse sector structures having an opening for the passage of fluid and being located at a front of the inner tube and a rear of the inner tube.

12. The device according to claim 11, wherein the pump comprises an annular hydraulic piston selectively movable between an extended position and a retracted position.

13. The device according to claim 12, wherein the inner tube has a plurality of lengthwise openings for circulation of fluid.

14. The device according to claim 12, further comprising a return circuit that returns the annular hydraulic piston to the retracted position.

15. The device according to claim 14, wherein the return circuit comprises a compressed air circuit.

16. The apparatus according to claim 11, wherein the pump comprises an annular hydraulic piston selectively movable between an extended position and a retracted position.

17. The apparatus according to claim 16, wherein the inner tube has a transverse structure forming a watertight bulkhead in the annular space at at least one of the front end and the rear end of the inner tube.

18. The apparatus according to claim 17, wherein the transverse structure forms the watertight bulkhead in the annular space at the front end and rear end of the inner tube.

19. The apparatus according to claim 16, wherein the launch tube has a stop on an internal face of the launch tube disposed between a front portion and a rear portion of the annular hydraulic piston, the stop having a front shoulder that engages the front portion in the extended position of the annular hydraulic piston and a rear shoulder that engages the rear portion in the retracted position of the annular hydraulic piston.

20. The apparatus according to claim 19, further comprising a hydraulic brake that pre-brakes the annular hydraulic piston before the annular hydraulic piston contacts the stop.

21. The apparatus according to claim 20, further comprising a sector damper that dampens sounds produced by the annular hydraulic piston.

22. The device according to claim 11, wherein the rear door opens to provide access to the inner tube and the annular space between the inner tube and the launch tube.

23. The device according to claim 11, wherein the fluid is propelled at a flow rate of about 2 $m^3$/sec.

24. Apparatus for ejecting a weapon from a submergible launch tube, comprising:

means for holding an inner tube within the launch tube with an annular space between the inner tube and the launch tube;

means for opening a front door of the launch tube; and means for displacing fluid in an annular space from a front area of the launch tube to a rear area of the launch tube, wherein the means for holding the inner tube comprises a plurality of transverse sector structures attached to the inner tube and configured to extend between the launch tube and the inner tube and to be attached to the launch tube, the plurality of transverse sector structures having an opening for the passage of fluid and being located at a front of the inner tube and a rear of the inner tube.

25. The device according to claim 24, wherein the fluid is displaced at a flow rate of about 2 $m^3$/sec.

* * * * *